US011120980B2

(12) United States Patent
Bae et al.

(10) Patent No.: US 11,120,980 B2
(45) Date of Patent: Sep. 14, 2021

(54) METHOD OF PREPARING SPECIMEN OF POORLY WATER-SOLUBLE MATERIAL FOR MALDI MASS SPECTROMETRY AND SAMPLE PLATE USED THEREIN

(71) Applicant: LG CHEM, LTD., Seoul (KR)

(72) Inventors: Yongjin Bae, Daejeon (KR); Young Hee Lim, Daejeon (KR); Yeu Young Youn, Daejeon (KR)

(73) Assignee: LG CHEM, LTD., Seoul (KR)

( * ) Notice: Subject to any disclaimer, the term of this patent is extended or adjusted under 35 U.S.C. 154(b) by 0 days.

(21) Appl. No.: 16/930,653

(22) Filed: Jul. 16, 2020

(65) Prior Publication Data

US 2021/0175061 A1 Jun. 10, 2021

(30) Foreign Application Priority Data

Dec. 6, 2019 (KR) ..... 10-2019-0161407

(51) Int. Cl.
*H01J 49/04* (2006.01)
*H01J 49/00* (2006.01)

(52) U.S. Cl.
CPC ..... *H01J 49/0418* (2013.01); *H01J 49/0031* (2013.01); *H01J 49/0431* (2013.01)

(58) Field of Classification Search
CPC . H01J 49/0418; H01J 49/0031; H01J 49/0431
See application file for complete search history.

(56) References Cited

FOREIGN PATENT DOCUMENTS

| | | | |
|---|---|---|---|
| JP | 2007309860 | A | 11/2007 |
| JP | 2015028474 | A | 2/2015 |
| JP | 2017138273 | A | 8/2017 |
| KR | 10-0544860 | B1 | 1/2006 |
| KR | 20170021398 | A | 2/2017 |
| WO | 2006083151 | A1 | 8/2006 |

OTHER PUBLICATIONS

Skelton R et al., "A MALDI Sample Preparation Method Suitable for Insoluble Polymers", Analytical Chemistry. Apr. 1, 2000, vol. 72, No. 7, pp. 1707-1710.

*Primary Examiner* — Nicole M Ippolito
*Assistant Examiner* — Hanway Chang
(74) *Attorney, Agent, or Firm* — Dentons US LLP

(57) ABSTRACT

The present disclosure relates to a method of manufacturing a specimen of a poorly water-soluble material having a uniform thickness by using a sample plate comprising a substrate and a plurality of protrusions located on one surface of the substrate, the protrusion having a flat surface for receiving a force when pressed from the top, and a method for quantitative analysis of a poorly water-soluble material through MALDI mass spectrometry for the specimen.

17 Claims, 6 Drawing Sheets

[Fig. 1a]
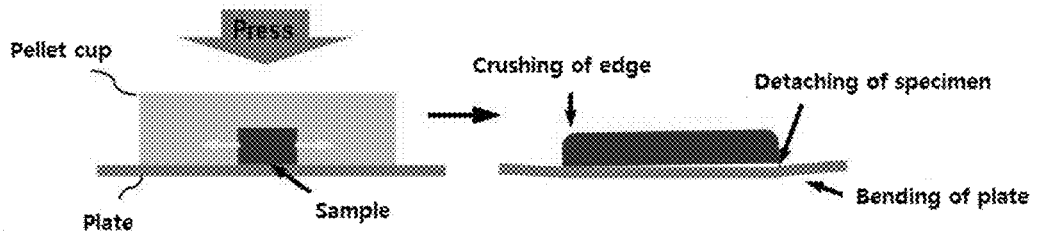
[Fig. 1b]
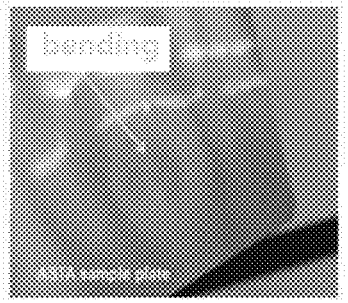
[Fig. 2]
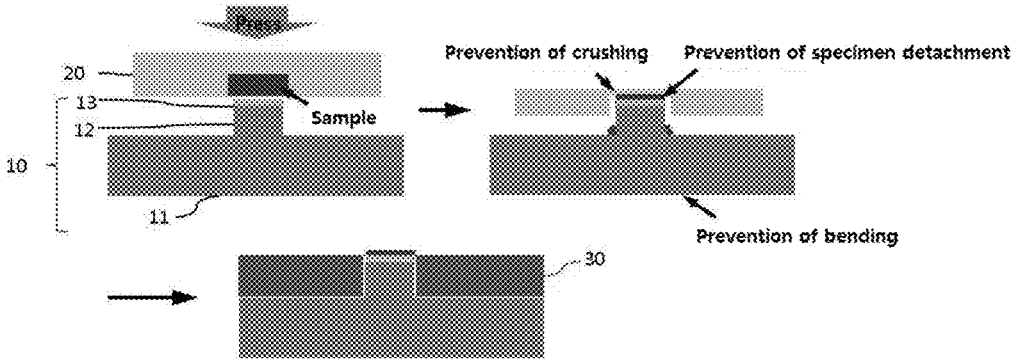

[Fig. 3]
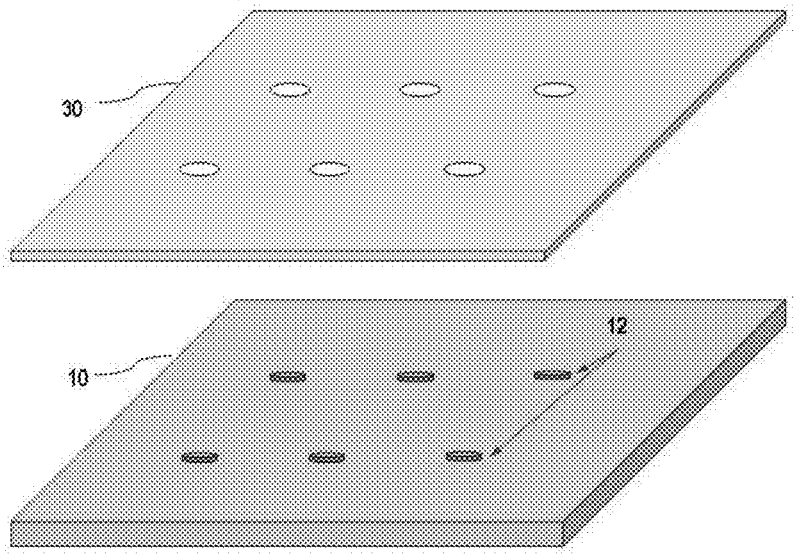
[Fig. 4]
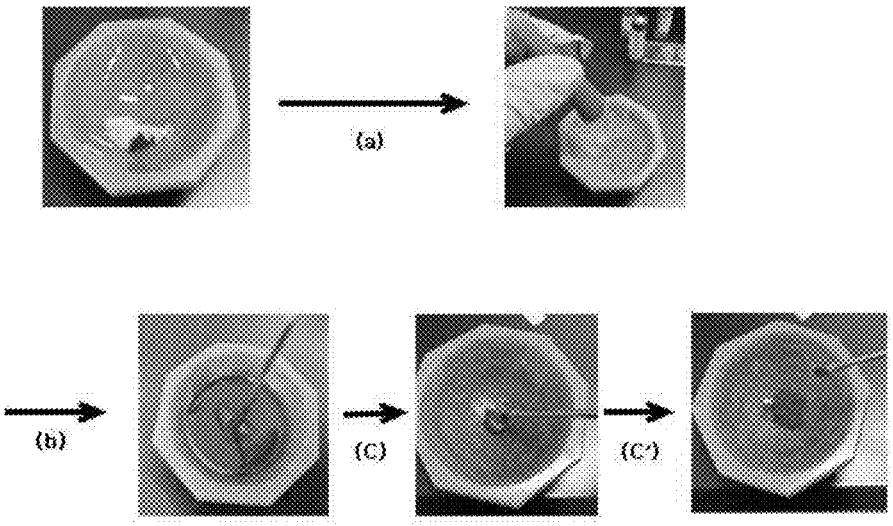

[Fig. 5]
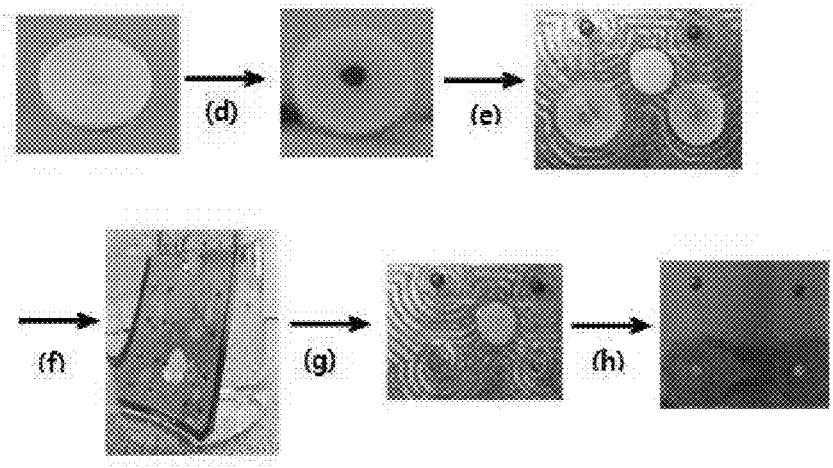
[Fig. 6]
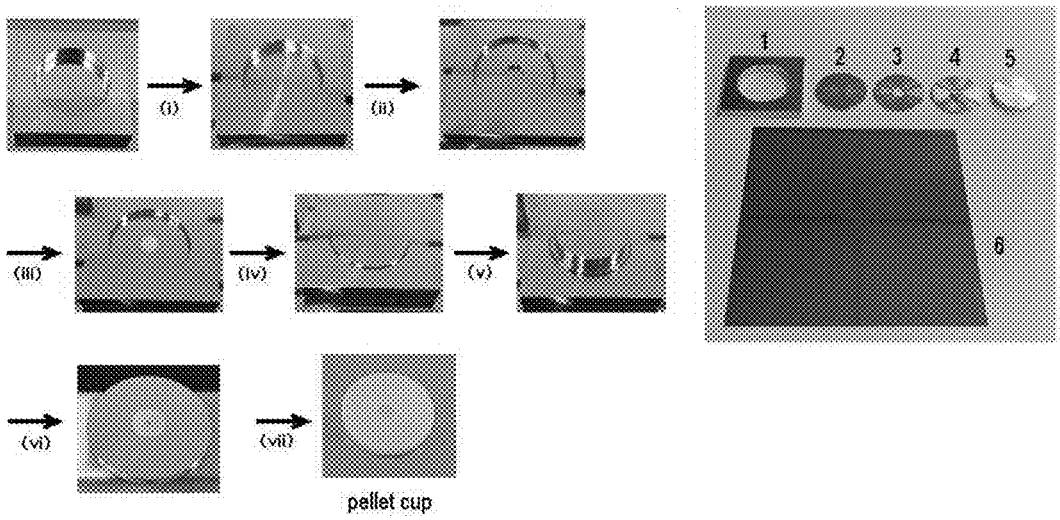

[Fig. 7a]
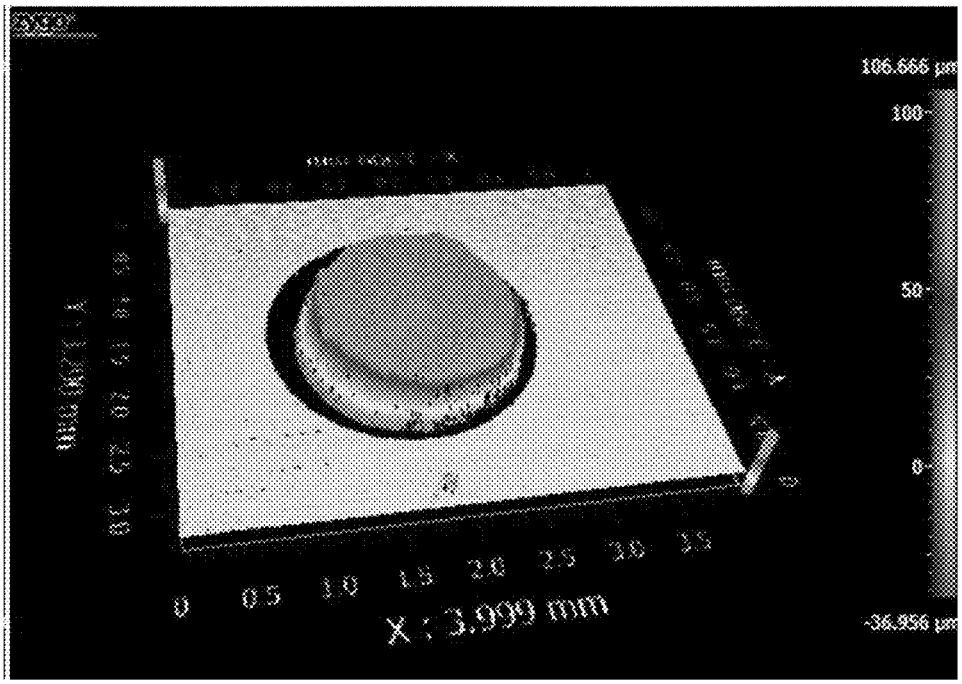
[Fig. 7b]
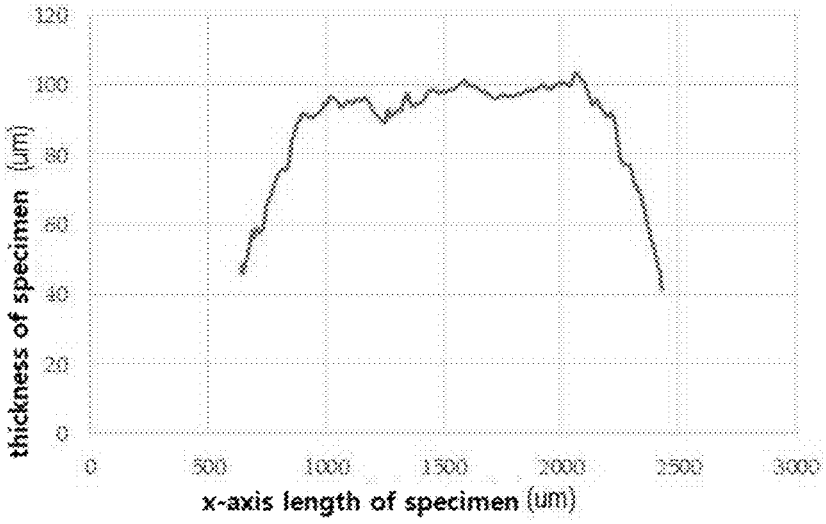

[Fig. 8]
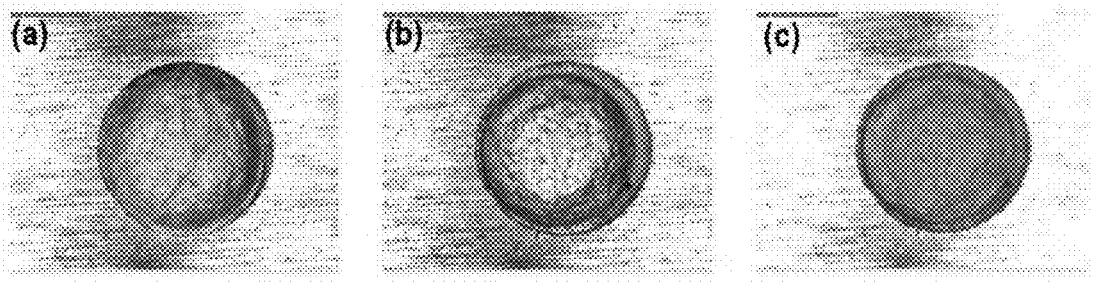
[Fig. 9a]
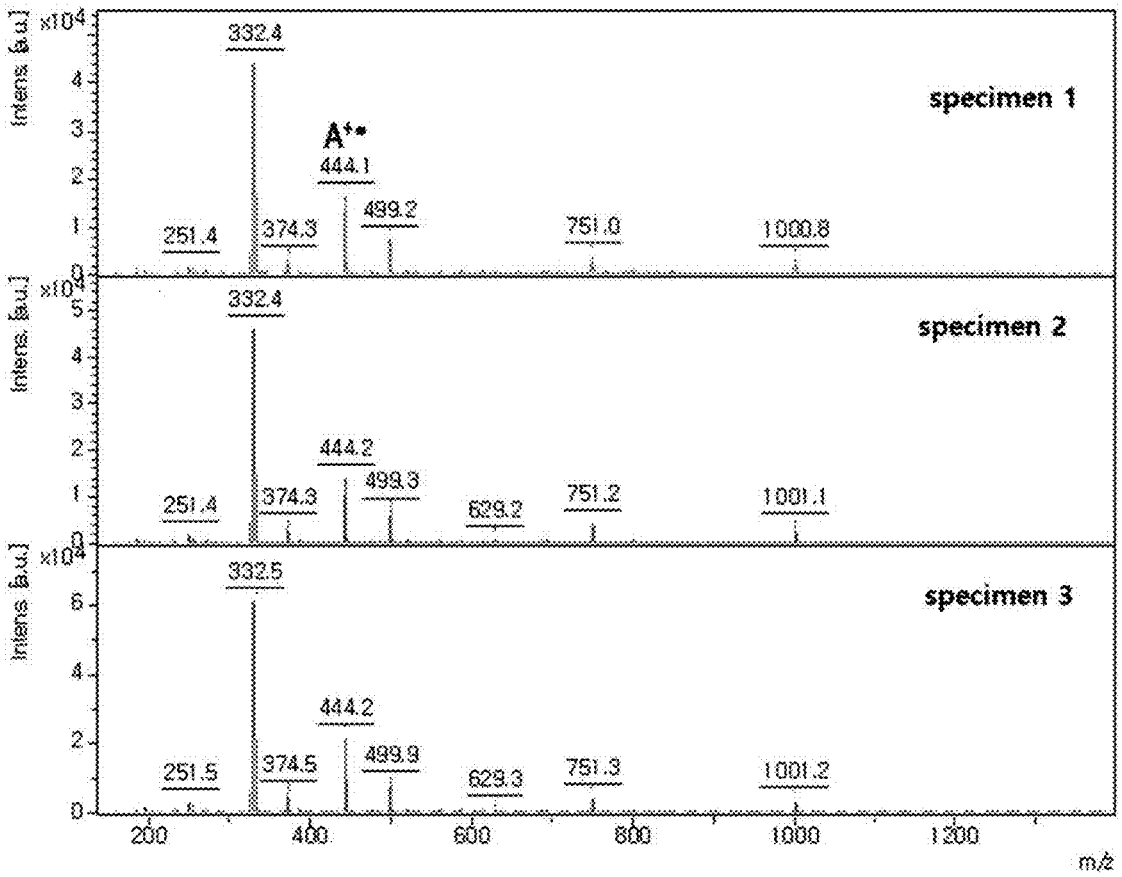

[Fig. 9b]
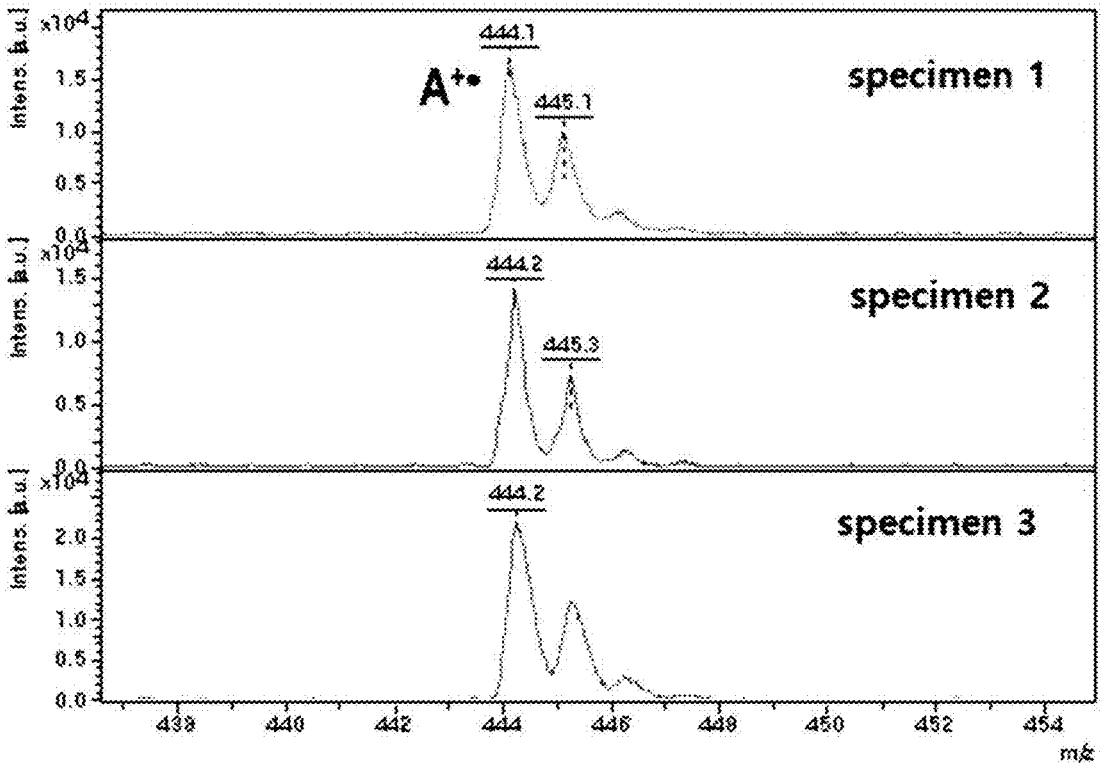
[Fig. 10]
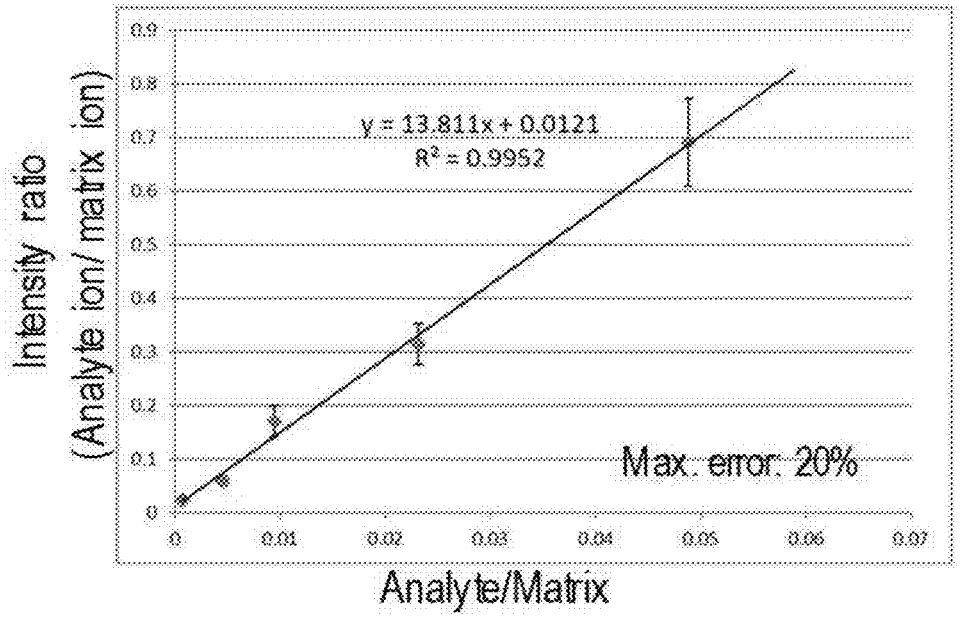

METHOD OF PREPARING SPECIMEN OF POORLY WATER-SOLUBLE MATERIAL FOR MALDI MASS SPECTROMETRY AND SAMPLE PLATE USED THEREIN

CROSS-REFERENCE TO RELATED APPLICATIONS

This application claims the benefit of and priority to Korean Application No. 10-2019-0161407, filed Dec. 6, 2019, the disclosures of which are hereby incorporated by reference in their entirety for all purposes as if fully set forth herein.

BACKGROUND OF THE INVENTION

1. Field of the Invention

The present invention relates to a method of preparing a specimen of a poorly water-soluble material for MALDI mass spectrometry and a sample plate used in the method.

2. Description of the Related Art

In order to obtain quantitative information from a mass spectrum, it is necessary to obtain a reproducible spectrum for the same sample and to prepare a linear calibration line according to the concentration of the sample.

MALDI-TOF mass spectrometry (Matrix-Assisted Laser Desorption Ionization-Time of Flight Mass Spectrometry, hereinafter simply referred to as "MALDI") is a mass spectrometry capable of analyzing insoluble materials. However, MALDI is known to be difficult to use for accurate quantitative analysis since crystals resulted from mixing a sample and a matrix are heterogeneous, and due to laser shot-to-shot variability, ion signals are not stable and reproducibility of the spectrum is poor. Recently, it has been reported that reproducibility of the MALDI spectrum is secured for peptides and biological monomolecular substances. However, the quantitative method of synthetic polymers is not standardized and it is difficult to obtain a consistently effective result using a commercial MALDI-TOF MS equipment.

The present inventors have produced polymer specimens of uniform thickness by electrospray through a mask with holes for soluble polymer samples in order to increase reproducibility of the MALDI spectrum (Korean patent application No. 10-2017-0130010, Application date: 2017 Oct. 11, Applicant: LG Chemical Co., Ltd.). In addition, the present inventors have discovered that the thickness of the specimen affects the reproducibility of the spectrum and prepared a linear calibration line using an internal standard from the reproducible MALDI spectrum obtained using polymer specimens having a small thickness deviation for each concentration (Korean patent application No. 10-2017-0157161, Application date: 2017 Nov. 23, Applicant: LG Chemical Co., Ltd.). All contents disclosed in the above patent literatures are incorporated herein by reference. However, these methods were not applicable to poorly soluble and insoluble materials.

Accordingly, the present inventors have produced a specimen by pressing a certain amount of a sample (a mixture of a poorly water-soluble material and a matrix) at a constant pressure using a pellet cup made of a water-soluble material in a certain area on a commercial sample plate to provide a homogeneous specimen with a low thickness deviation which is suitable for MALDI mass spectrometry of poorly soluble or insoluble materials (Korean patent application No. 10-2018-0108097, Application date: 2018 Sep. 11, Applicant: LG Chemical Co., Ltd.). All contents disclosed in the above patent literatures are incorporated herein by reference.

However, in the method of preparing a specimen as described above, there is a disadvantage that it is difficult to manufacture a uniform specimen due to bending of the sample plate, crushing of edges of the specimen, and detaching of the specimen from the sample plate or the like as the pellet cup is pressed directly onto the commercial sample plate (see, FIG. 1). In addition, in the case of bending of the sample plate, it is difficult to maintain a position of the specimen relative to the irradiated laser without change during MALDI mass spectrometry and it is difficult to secure reproducibility of the spectrum due to distortion of the electric field.

SUMMARY OF THE INVENTION

To solve the problems of the prior art, the object of the present invention is to provide a method for increasing reproducibility of producing a specimen having a uniform thickness, in which a sample plate of a specific structure is used when preparing a specimen of a poorly water-soluble material for MALDI mass spectrometry, so that the phenomenon of crushing or detaching of the specimen during the pressing can be prevented and the plate can be re-used because the plate itself is not bent.

Another object of the present disclosure is to provide a dedicated sample plate used in the method of preparing a specimen of a poorly water-soluble material for MALDI mass spectrometry.

Another object of the present disclosure is to provide a method for obtaining a reproducible MALDI spectrum for specimens of poorly water-soluble materials having a uniform thickness manufactured by the above method and quantitatively analyzing the poorly water-soluble material therefrom.

According to one aspect of the present invention, there is provided a method of preparing a specimen of a poorly water-soluble material for MALDI mass spectrometry, comprising:

(S1) preparing a sample plate comprising a substrate and a plurality of protrusions located on an upper portion of the substrate, the protrusion having a flat surface for receiving a force when pressed from the top;

(S2) mixing a poorly water-soluble material and a matrix, and then introducing a volatile solvent to disperse the poorly water-soluble material and the matrix until the volatile solvent is evaporated, thereby obtaining a sample of the poorly water-soluble material; and (S3) filling the sample obtained in the step (S2) into a groove of a pellet cup made of a water-soluble material, turning the pellet cup over so that the groove of the pellet cup is positioned on the protrusion of the sample plate, pressing from the top, and then dissolving the pellet cup with water to form a specimen of the poorly water-soluble material.

In addition, the present invention provides a sample plate for use in the production of specimens of poorly water-soluble materials for MALDI mass spectrometry, comprising a substrate and a plurality of protrusions located on one surface of the substrate, the protrusion having a flat surface for receiving a force when pressed from the top.

In addition, the present disclosure provides a method for quantitative analysis of a poorly water-soluble material by using the specimen of the poorly water-soluble material prepared by the above described method, comprising:

obtaining a MALDI mass spectrum for the specimen of the poorly water-soluble material; and calculating a signal intensity ratio of the poorly water-soluble material to the matrix from peak results of the MALDI mass spectrum and plotting the signal intensity ratio versus a weight ratio of the poorly water-soluble material to the matrix, thereby preparing a quantitative calibration line.

Effect of the Invention

According to the present disclosure, in case that the sample plate provided with protrusions is used for the preparation of specimens of the poorly water-soluble materials for MALDI mass spectrometry together with a pellet cup, pressure is mainly applied to the portion where the specimen is introduced when the pellet cup containing the sample is pressed on the protrusion. Thereby, the phenomenon of crushing of edges of the specimen due to crushing of the pellet cup and detaching of the specimen from the sample plate during the pressing can be prevented and bending of the sample plate can be prevented to allow reuse and improve reproducibility of specimen preparation.

Accordingly, it is possible to prepare a homogeneous specimen of a poorly water-soluble material having a small thickness deviation, and a reproducible MALDI spectrum can be obtained from the specimen, thereby enabling quantitative analysis of a poorly water-soluble material with a commercial MALDI-TOF MS equipment.

BRIEF DESCRIPTION OF THE DRAWINGS

FIG. 1*a* shows a procedure of inverting and pressing a pellet cup containing a sample on a commercial sample plate in the method of manufacturing a specimen of a poorly water-soluble material for MALDI mass spectrometry of the prior art.

FIG. 1*b* shows an appearance of the commercial sample plate bent after the pressing process used in the prior art.

FIG. 2 schematically shows a procedure of inverting and pressing a pellet cup containing a sample on a sample plate provided with protrusions in the method of preparing a specimen of a poorly water-soluble material for MALDI mass spectrometry according to one embodiment of the present invention.

FIG. 3 illustrates schematic structures of a dedicated sample plate and a cover used in the method of preparing a specimen for MALDI mass spectrometry according to one embodiment of the present invention.

FIG. 4 illustrates a procedure of obtaining a specimen of a poorly water-soluble material in the method of preparing a specimen for MALDI mass spectrometry according to one embodiment of the present invention.

FIG. 5 illustrates a procedure of forming a specimen of a poorly water-soluble material in the method of preparing a specimen for MALDI mass spectrometry according to one embodiment of the present invention.

FIG. 6 illustrates a procedure of manufacturing a pellet cup used in the method of preparing a specimen for MALDI mass spectrometry according to an embodiment of the present invention.

FIGS. 7*a* and 7*b* are an image of the specimen measured by the optical profiler of the specimen prepared in Example 3, and a thickness profile plotting the thickness of the cross section in the x-axis direction through the center of each specimen, respectively.

FIG. 8 is a photomicrograph of the specimens prepared in Examples 1 to 3 of the present disclosure.

FIGS. 9*a* to 9*b* are the overall MALDI mass spectrum and the enlarged spectrum around m/z 444 of the pigment (PR177) obtained from the three specimens of poorly water-soluble materials prepared in Example 3, respectively.

FIG. 10 shows a linear quantitative calibration line from plotting the signal intensity ratio of the analyte (PR177 as a poorly water-soluble material) to the matrix against the weight ratio of the analyte to the matrix, from the result of the MALDI mass spectrum of FIG. 9.

DETAILED DESCRIPTION OF THE INVENTION

Since various modifications and variations can be made in the present invention, particular embodiments are illustrated in the drawings and will be described in detail in the detailed description. It should be understood, however, that the invention is not intended to be limited to the particular embodiments, but includes all modifications, equivalents, and alternatives falling within the spirit and scope of the invention. In the following description of the present invention, detailed description of known functions will be omitted if it is determined that it may obscure the gist of the present invention.

As used herein, the term "poorly water-soluble" is meant to encompass both insoluble and difficult to dissolve in water.

As used herein, the term "homogeneity" or "homogeneous" refers to a state in which components contained in a sample or specimen in a proportion are uniformly distributed with each other.

Hereinafter, the present invention will be described in more detail.

One embodiment of the present invention relates to a method of preparing a specimen having a uniform thickness in which samples of poorly water-soluble materials are homogeneously distributed to obtain a reproducible MALDI spectrum of the poorly water-soluble material. The method comprises (S1) preparing a sample plate provided with protrusions; (S2) obtaining a sample of a poorly water-soluble material; and (S3) pressing a pellet cup containing the sample on the sample plate to form the specimen. Hereinafter, a method for manufacturing a specimen of the present disclosure will be described for each step with reference to the drawings.

FIG. 2 schematically shows the procedure of inverting and pressing a pellet cup containing the sample on the sample plate provided with protrusions in the method of preparing a specimen of a poorly water-soluble material for MALDI mass spectrometry according to one embodiment of the present invention.

In the step (S1) of the method for preparing specimens according to the present disclosure, a dedicated sample plate 10 is prepared.

Referring to FIG. 2, the sample plate 10 for use in the method for preparing a specimen of the present disclosure comprises a substrate 11 and protrusions 12 positioned on the substrate.

The substrate 11 on which the protrusions are formed in the sample plate 10 of the present disclosure may be made of a material comprising aluminum, stainless steel, copper, or alloys thereof.

The thickness of the substrate may be 2.0 to 3.5 mm, for example, 2.2 to 2.8 mm, and when the above range of thickness is satisfied, bending of the sample plate when pressed from the top can be prevented to allow reuse the sample plate, thereby improving the reproducibility of specimen preparation.

The protrusion 12 provided on the sample plate 10 of the present disclosure is a portion that is mainly applied with pressure when the pellet cup containing the sample is turned upside down and pressed during sample preparation. It has a certain height and a flat surface for receiving the force when pressed from the top.

The height of the protrusion may be 0.3 to 0.7 mm, for example 0.5 mm, and when the above range of height is satisfied, the sufficient pressure can be maintained when pressed from the top and the sample plate itself can be subjected to less pressure.

The flat surface of the protrusion may have a circular shape to correspond to a groove of the pellet cup filled with the sample. In addition, the diameter of the protrusion can be adjusted according to the groove size of the pellet cup, for example, may have a diameter of 1.5 to 3 mm, specifically 1.8 mm to 2 mm.

A coating layer 13 made of a hydrophobic material may be formed on the flat surface of the protrusion, and the hydrophobic coating layer 13 may prevent water from penetrating between the specimen and the protrusion in a subsequent step, thereby preventing the specimen from detaching. Examples of the hydrophobic material include polytetrafluoroethylene, polydimethylsiloxane, polyethylene, polypropylene, polymethylmethacylate, paraffine or a mixture thereof.

In addition, the sample plate may further include a cover 30 capable of stably maintaining the electric field during MALDI analysis. The cover may prevent distortion of an electric field that may be generated by the protrusion when voltage is applied in the MALDI analysis process.

FIG. 3 illustrates a schematic structure of a sample plate 10 and a cover 30 provided with a plurality of protrusions 12 on which a hydrophobic coating layer is formed according to the present invention.

The cover may be made of the same material as the substrate 10 described above and have a plurality of holes. It may have a thickness equal to the height of the protrusion, that is, 0.3 to 0.7 mm, for example, 0.5 mm.

Since the dedicated sample plate as described above to be used for the preparation of the specimen for MALDI mass spectrometry is pressed while the groove portion of the pellet cup containing the sample is positioned on the protrusion provided on the plate, the pressure is not applied to the entire pellet cup, but only to the protrusion and therefore the phenomenon of crushing of edges of the specimen due to crushing of the pellet cup does not occur. In addition, by coating the surface of the protrusion with a hydrophobic material, the penetration of water between the specimen and the protrusion can be prevented and thus detaching of the sample from the sample plate during dissolving the pellet cup in water can be prevented.

Accordingly, it is possible to overcome the disadvantages of difficulty of preparing a uniform specimen from the bending of the sample plate, the crushing of edges of the specimen, and the detaching of the specimen from the sample plate when the pellet cup is directly pressed on the commercial sample plate as shown in FIG. 1. In addition, the bending of the sample plate can be prevented, so that the relative position of the irradiated laser and the specimen can be maintained constantly during MALDI mass spectrometry and the distortion of electric field can be prevented to contribute to securing reproducibility of the MALDI mass spectrum.

In the step (S2) of the method of preparing a specimen according to the present disclosure, a poorly water-soluble material and a matrix are mixed, and then a volatile solvent is introduced to disperse the poorly water-soluble material and the matrix until the volatile solvent is evaporated, thereby obtaining a sample of the poorly water-soluble material.

FIG. 4 illustrates the procedure of obtaining a sample used in the present disclosure. Referring the FIG. 4, the poorly water-soluble material and the matrix are mixed in a mortar & pestle (a), a volatile solvent is introduced to the mixture to dissolve the matrix, and the poorly water-soluble material is dispersed in the resulting solution (b), and then the dispersion is stirred with a spatula until the used volatile solvent is evaporated (c and c'), thereby obtaining a sample of the poorly water-soluble material.

In the present disclosure, after mixing the analyte (a poorly water-soluble material) and the matrix using a mortar & pestle (step a), a volatile solvent is used to dissolve the matrix, and the poorly water-soluble material is dispersed in the resulting solution in order to increase the homogeneity of the sample (step b), then the matrix and the poorly water-soluble material are homogeneously mixed until evaporation of the solvent while maintaining the dispersion state (steps c and c'). According to the procedure of obtaining the sample, the homogeneity of the sample is improved and static electricity is not generated in the sample, thereby improving the handling of the sample.

The degree of uniform distribution of each component in the obtained sample can be evaluated from the error range of the MALDI spectrum result for the specimen prepared from the sample. It can be evaluated that the smaller the error range, the better the distribution uniformity, i.e., the homogeneity of the sample.

In one embodiment, the poorly water-soluble material includes an anthraquinone pigment, such as Pigment Red 177 (PR177, 4,4'-diamino[1,1'-bianthracen]-9,9',10,10'-tetraone), a copper phthalocyanine pigment, a perylene pigment, a diketopyrrolopyrrole pigment, a benzimidazolone pigment, an isoindoline pigment, a dioxazine pigment or the like, but is not limited thereto.

In one embodiment, the matrix to be mixed with the poorly water-soluble material, which is a substance having low solubility in water, may be selected from DCTB (trans-2-[3-(4-tert-butylphenyl)-2-methyl-2-propenylidene]malononitrile), DPF (α,β-diphenylfumaronitrile), α-cyano-4-hydroxycinnamic acid, Dithranol (1,8,9-trihydroxyanthracene), or the like, but is not limited thereto.

The amounts of the poorly water-soluble material and the matrix are not particularly limited, but may be in a weight ratio of 1:20 to 1:100, such as 1:20.

In one embodiment, the volatile solvent added to the poorly water-soluble material and the matrix may be one or more selected from tetrahydrofuran (THF), chloroform, and the like, but is not limited thereto.

In one embodiment, in addition to a mortar & pestle, a ball mill may be used when mixing the poorly water-soluble material and the matrix.

In the step (S3) of the method for manufacturing a specimen according to the present invention, the sample obtained in the step (S2) is filled into a groove of a pellet cup made of a water-soluble material, the pellet cup is turned over so that the groove of the pellet cup is positioned on the protrusion of the sample plate, and then the pellet cup is pressed from the top, and the pellet cup is dissolved in water to form a specimen of the poorly water-soluble material.

FIG. 5 illustrates an example of a procedure of forming a specimen using a dedicated sample plate according to the present invention.

Referring to FIG. 5, a pellet cup of a water-soluble material is prepared to fill the sample of the poorly water-soluble material into its groove (d), the groove of the inverted pellet cup is positioned on the flat surface of the protrusion provided on the sample plate, followed by pressing it (e), the used pellet cup is dissolved in water (f), and dried with a nitrogen ($N_2$) blowing to form a specimen (g), and a sample plate is covered (h).

In one embodiment, the pressing may be performed for 10 to 20 seconds at a pressure of 1 to 5 ton using a hot press.

In addition, in order to reduce the thickness deviation of the specimen, a secondary pressing may be performed by applying a constant pressure (for example, 3 tons) for about 20 seconds with covering a grooveless pellet cup on the previously prepared specimen. The pellet cup used in this process is dissolved in water and dried with nitrogen blowing to remove moisture, as in the case of specimen preparation.

In addition, the prepared specimen may undergo additional drying at high temperature to completely remove moisture that may be trapped to remain in the specimen and the sample plate. If the moisture remains, it is difficult to maintain the vacuum state and conduct the experiment as the residual moisture evaporates during MALDI mass spectrometry.

The additional drying process may be performed at about 100° C. for 10 to 20 minutes (e.g., 15 minutes).

In the present invention, in order to press a certain amount of the homogeneous sample of the poorly water-soluble material obtained as described above at the constant pressure between samples in a certain area during sample preparation, a pellet cup is used as a means of confining the same amount of the sample to a certain area. The pellet cup may be used without limitation as long as it is made of a water soluble material that can be dissolved in water. For example, a pellet cup made of KBr, NaBr, $MgBr_2$, NaCl, or a mixture thereof may be used.

FIG. 6 illustrates a procedure of manufacturing a KBr pellet cup used in the method of preparing specimens for MALDI mass spectrometry according to an embodiment of the present invention.

Referring to FIG. 6, a unit for manufacturing a KBr pellet cup may include a flat square plate 6, a square frame 1 with a circular hole at the center, which is placed on the plate 6, circular members 2, 3, and 4, which are placed in the circular hole of the square frame 1 in this order, and a circular member 5 which is placed on the circular member 4 and then pressed. The specific procedure of manufacturing a KBr pellet cup is as follows.

First, the frame 1 with a circular hole at the center is placed on the plate 6, and the circular member 2 is put in the circular hole of the frame 1 (step i). The plate 6 is used during the entire process from the production of the KBr pellet cup to the production of the specimen. The shape, the dimension and the material of the plate 6 are not particularly limited as long as the entire process of production of the specimen can be easily performed. Subsequently, the circular member 3 is placed on the circular member 2 (step ii). At this time, the circular member 2 has a convex portion at the center, and the circular member 3 has a shape with a small circular hole at the center. Subsequently, KBr is filled in the center hole of the circular member 3 (step iii). The convex portion and its size of the circular member 2 and the hole and its size of the center of the circular member 3 correspond to the shape and dimension of the KBr pellet cup to be described later. As KBr is sufficiently filled in the center hole of the circular member 3, the circular member 4 is placed thereon (step iv). The circular member 4 has a convex portion at the center. Thereafter, the circular member 5 is placed on the circular member 4 (step v), and then pressing is performed (step vi). At this time, the same pressure is applied over the entire area of the circular member 5. Since the circular members 2, 3 and 4 are put in the circular hole of the frame 1 in this order, they must be sized to exactly fit the circular hole of the frame 1. After pressing the circular member 5 sufficiently, the circular members 5 and 4 are removed and the circular member 2 and the frame 1 are removed, leaving only the circular member 3 on the plate 6. KBr is firmly filled in the center hole of the circular member 3 by pressing. Finally, the circular member 3 is removed to complete the KBr pellet cup (step vii). The completed pellet cup is shaped to be grooved at the center by the convex portion of the circular member 2.

In the present disclosure, the shape and dimension of the frame 1 are not particularly limited, but it is preferable that all of the circular members 2, 3, and 4 are inserted into the circular hole of the frame 1, so that the thickness of the frame may be equal to or greater than the thickness when combining the circular members 2, 3 and 4. The circular member 5 should be smaller than the circular member 4 in order to facilitate pressing. The material of the circular members 1 to 5 is not particularly limited, and for example, stainless steel, aluminum, or the like.

In one embodiment, the pressing may be performed using a hot press. For example, the pressing may be performed at a pressure of 1 to 5 tons for 10 to 20 seconds.

The sizes of the circular hole of the frame 1 and the hole at the center of the circular member 3 are not particularly limited.

In one embodiment, the pellet cup may have a circular or polygonal form.

The pellet cup as described above can be pressed at the same pressure per unit volume with the sample being confined therein, making it possible to produce a uniform specimen. In addition, it is possible to prevent the specimen surface from damage due to the press, by dissolving in water only the pellet cup, not the sample pressed together with the pellet cup.

The specimen of the poorly water-soluble material for MALDI mass spectrometry prepared according to the present disclosure may have a thickness of 70 to 100 μm, such as 78 to 95 μm (average 86 μm).

In addition, when a plurality of specimens is measured for the thickness at a plurality of spots, for example, three or more spots, a deviation of ±10 μm with respect to an average thickness of 86 μm is exhibited, so that the thickness deviation may be 30% or less, such as 25% or less.

The specimen thickness and thickness deviation can be measured by a method commonly used in the art. For example, it can be measured by calculating the average thickness and thickness deviation at a radius of 700 μm from the center for three or more specimens using a three-dimensional surface analyzing device such as an optical profiler.

As described above, according to the present disclosure, by preparing a specimen of a poorly water-soluble material using a dedicated sample plate, a reproducible MALDI spectrum can be obtained by minimizing a specimen thickness deviation while securing a specimen thickness suitable for MALDI mass spectrometry, from which it is possible to quantitatively analyze a sample of poorly water-insoluble material.

Therefore, the present invention provides a method for quantitative analysis of a poorly water-soluble material by MALDI mass spectrometry.

Specifically, the analysis method may comprise obtaining a MALDI mass spectrum for the specimen of poorly water-soluble material; and calculating a signal intensity ratio of the poorly water-soluble material to the matrix from peak results of the MALDI mass spectrum and plotting the signal intensity ratio versus a weight ratio of the poorly water-soluble material to the matrix, thereby preparing a quantitative calibration line.

The MALDI mass spectrum can be obtained by irradiating the specimen with a laser using a commercial MALDI-TOF MS equipment.

The spectrum may appear differently depending on the number of shots during laser irradiation on the specimen. That is, the area of the specimen surface to which the laser is irradiated is varied depending on the thickness of the specimen. This can change the temperature of the plume, which is the vapor generated from the specimen by the laser, making it difficult to secure reproducibility of the spectrum.

Considering that the thickness range of the specimen of the poorly water-soluble material according to the present disclosure is 70 to 100 μm, such as 78 to 95 μm (average 86 μm), it is advantageous to acquire spectra of 300 to 600 shots per spot in the specimen in order to secure the reproducibility of MALDI mass spectrum with the minimized change of peak position and peak intensity ratio.

In one embodiment, the relative standard deviation (RSD) representing an error of a relative ratio of analyte peak to matrix peak of the MALDI mass spectrum may be 40% or less, in particular may range from 20% to 30%, wherein the MALDI mass spectrum is obtained by preparing a plurality of specimens of poorly water-insoluble material and laser irradiating at three or more spots for each specimen.

This demonstrates that the MALDI spectrum obtained from the specimen of the poorly water-soluble material according to the present invention has spot-to-spot reproducibility and sample-to-sample reproducibility.

In addition, a quantitative calibration line prepared by using the results of the reproducible MALDI spectrum, that is, a quantitative calibration line showing the signal intensity ratio of the poorly water-soluble material to the matrix against the weight ratio of the poorly water-soluble material to the matrix are all linear (see FIG. 9), from which it is possible to quantitatively analyze the poorly water-soluble material.

Hereinafter, embodiments of the present invention will be described in detail so that those skilled in the art can easily carry out the present invention. The present invention may, however, be embodied in many different forms and should not be construed as limited to the embodiments set forth herein.

Example 1

Step 1: Preparation of Sample Plate Provided with Protrusion

As schematically shown in FIG. 3, a sample plate 10 (overall thickness: 2.8 mm) was prepared which has a plurality of protrusions 12 (diameter: 1.8 mm, height: 0.5 mm) formed on a substrate (thickness: 2.3 mm) of stainless steel having a size of 113.5 mm×82 mm, the surface of the protrusion coated with polytetrafluoroethylene (Teflon®). In addition, a cover 30 having the same thickness as the height of the protrusion was prepared.

Step 2: Preparation of Sample

Pigment Red 177 (PR177, $C_{28}H_{16}N_2O_4$, Exact Mass 444.11) represented by the following formula as a poorly water-soluble material to be analyzed and DCTB (trans-2-[3-(4-tert-butylphenyl)-2-methyl-2-propenylidene]malononitrile) as a matrix were used. As shown in FIG. 4, the poorly water-soluble material and the matrix were mixed in a mortar & pestle in a weight ratio of 1:20 and ground with a mortar. THF (2 mL) was added thereto as a volatile solvent for dispersing the mixture and continued to mix. Subsequently, it was continuously mixed while stirring with a spatula until THF was evaporated to obtain a sample having the poorly water-soluble material and the matrix uniformly distributed.

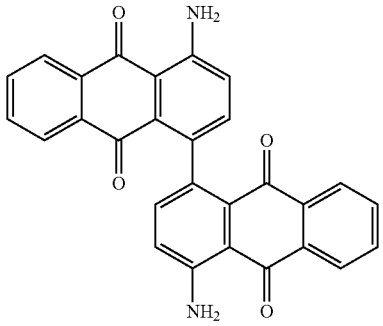

<Pigment Red 177>

Step 3: Preparation of Specimen

The sample prepared in the step 2 was filled into the groove of the KBr pellet cup prepared as shown in FIG. 5. The KBr pellet cup filled with the sample was turned upside down and mounted on the protrusion of the sample plate prepared in the step 1, and then the pressure of 2 tons was applied to the KBr pellet cup for 20 seconds. Subsequently, KBr was dissolved in water and drying with $N_2$ blowing was carried out to prepare a PR177 specimen.

A stainless steel cover was placed on the sample plate on which the specimen was formed to maintain the electric field stably.

Example 2

After carrying out the same procedure as in Example 1, a second pressing was performed by applying a pressure of 3 tons for 20 seconds with covering a grooveless KBr pellet cup on the specimen, and the KBr was dissolved in water and drying with $N_2$ blowing was carried out.

Example 3

After carrying out the same procedure as in Example 2, the specimen was placed in an oven and further dried at 100° C. for 15 minutes.

Comparative Example 1

Step 1: Preparation of Sample A sample was prepared in the same manner as in the step 2 of Example 1.

Step 1: Preparation of Specimen

The same procedure as in the step 3 of Example 1 was performed except that a disposable sample plate (ASTA) having a thickness of 0.3 mm was purchased and used for specimen preparation.

As a result, after the pressing process, the disposable sample plate (ASTA) was bent as can be seen in FIG. 1*b*.

Experimental Example 1: Measurement of Thickness and Thickness Deviation of Specimen To confirm the thickness and thickness deviation of the specimen, the specimens prepared in Examples 1 to 3 were analyzed with an optical profiler.

FIG. 7*a* is an image of the specimen measured by the optical profiler of the specimen prepared in Example 3, in which the thickness of the specimen appears to be uniform.

FIG. 7*b* is a thickness profile plotting the thickness of the cross section in the x-axis direction through the center of the specimen prepared in Example 3, from which it is found that for three specimens, a calculation result of the average thickness and thickness deviation at a radius of 700 μm from the center is 86±9 μm.

Experimental Example 2: Evaluation of Homogeneity of Specimen

In order to confirm the homogeneity of the specimens prepared in Examples 1 to 3, they were observed under a microscope (magnification ×90), and the results are shown in FIG. 8.

In FIG. 8, (a) is a microscope of the specimen after the first pressing in Example 1, (b) is a microscope of the specimen after the first pressing and the second pressing in Example 2, and (c) is a microscope of the specimen after the first and second pressing and dying in the oven in Example 3, which show that all three specimens were manufactured uniformly.

From the surface condition, in FIG. 8(*a*), it is found that there are cracks on the surface of the first pressed specimen, which is assumed to be occurred when the pellet cup is broken during the first pressing. In FIG. 8(*b*), it is found that since the cracks generated during the first pressing disappeared performing the second pressing on the specimen, the second pressing reduces the thickness deviation in the specimen and makes the surface smoother. In FIG. 8(*c*), it is found that there is no significant difference in homogeneity and surface condition, but the overall color of the specimen fades, which is a result of evaporation of moisture remaining in the specimen. Also, it is expected to increase the reproducibility of the spectrum obtained during MALDI mass spectrometry.

Experimental Example 3: Evaluation of Reproducibility of MALDI Spectrum

Three specimens were prepared according to Example 3, and each of the specimens was irradiated with a laser at 10 spots using a MALDI-TOF mass spectrometer (UltrafleXtreme, Bruker Daltonics, Germany). Spectra corresponding to 300 to 600 shots per spot were obtained and the average is shown in FIGS. 9*a* and 9*b*.

FIGS. 9*a* to 9*b* are the overall MALDI mass spectrum and the enlarged spectrum around m/z 444 of the pigment (PR177).

From FIG. 9, it is found that the peak intensity patterns and the peak positions of the spectra obtained on the three specimens are similar. In addition, the error (RSD) obtained by measuring a relative ratio of the peak of analyte (PR177) to the peak of matrix (m/z 332) was ±12%, indicating spot-to-spot reproducibility and sample-to-sample reproducibility.

Experimental Example 4: Evaluation of Availability of Quantitative Measurement of MALDI Spectrum A signal intensity ratio of analyte (PR177) to matrix was calculated using peaks of the mass spectrum of FIG. 9, and the ratio was plotted against a weight ratio of analyte to matrix to prepare a quantitative calibration line. The results are shown in FIG. 10.

Specifically, FIG. 10 shows a linear quantitative calibration line created using matrix peaks corresponding to m/z 332 ($R^2$=0.99 or more).

While the present invention has been particularly shown and described with reference to specific embodiments thereof, it will be apparent to those skilled in the art that this specific description is merely a preferred embodiment and that the scope of the invention is not limited thereby. It is therefore intended that the scope of the invention be defined by the claims appended hereto and their equivalents.

What is claimed is:

1. A method of preparing a specimen of a poorly water-soluble material for MALDI mass spectrometry, comprising:

(S1) preparing a sample plate comprising a substrate and a plurality of protrusions located on an upper portion of the substrate, the protrusion having a flat surface for receiving a force when pressed from the top;

(S2) mixing a poorly water-soluble material and a matrix, and then introducing a volatile solvent to disperse the poorly water-soluble material and the matrix until the volatile solvent is evaporated, thereby obtaining a sample of the poorly water-soluble material; and (S3) filling the sample obtained in the step (S2) into a groove of a pellet cup made of a water-soluble material, turning the pellet cup over so that the groove of the pellet cup is positioned on the protrusion of the sample plate, pressing from the top, and then dissolving the pellet cup with water to form a specimen of the poorly water-soluble material.

2. The method according to claim 1, wherein the protrusion has a diameter of 1.5 to 3 mm and a height of 0.3 to 0.7 mm.

3. The method according to claim 2, wherein the protrusion has a diameter of 1.8 mm and a height of 0.5 mm.

4. The method according to claim 1, wherein the pellet cup is manufactured to have a groove having a diameter of 1.5 to 3 mm and a depth of 0.3 to 0.7 mm.

5. The method according to claim 1, wherein the flat surface of the protrusion is coated with a hydrophobic material comprising polytetrafluoroethylene, polydimethylsiloxane, polyethylene, polypropylene, polymethylmethacylate, paraffine or a mixture thereof.

6. The method according to claim 1, wherein the substrate is made of a material comprising aluminum, stainless steel, copper, or alloys thereof.

7. The method according to claim 1, wherein after the step (3), the sample plate on which the specimen is formed is covered with a cover having the same height as the height of the protrusion to maintain the electric field stably.

8. The method according to claim 1, wherein the poorly water-soluble material comprises an anthraquinone pigment, a copper phthalocyanine pigment, a perylene pigment, a diketopyrrolopyrrole pigment, a benzimidazolone pigment, an isoindoline pigment, a dioxazine pigment or a mixture thereof.

9. The method according to claim 1, wherein the matrix comprises DCTB (trans-2-[3-(4-tert-butylphenyl)-2-methyl-2-propenylidene]malononitrile), DPF (α,β-diphenylfumaronitrile), α-cyano-4-hydroxycinnamic acid, Dithranol (1,8, 9-trihydroxyanthracene), or a mixture thereof.

10. The method according to claim 1, wherein the volatile solvent comprises tetrahydrofuran (THF), chloroform or a mixture thereof.

11. The method according to claim 1, wherein the pellet cup is made of KBr, NaBr, $MgBr_2$, NaCl or a mixture thereof.

12. A sample plate for the method according to claim 1.

13. A method for quantitative analysis of a poorly water-soluble material by using the specimen prepared by the method according to claim 1, comprising:

obtaining a MALDI mass spectrum for the specimen of the poorly water-soluble material; and calculating a signal intensity ratio of the poorly water-soluble material to the matrix from peak results of the MALDI mass spectrum and plotting the signal intensity ratio versus a weight ratio of the poorly water-soluble material to the matrix, thereby preparing a quantitative calibration line.

14. The method for quantitative analysis of a poorly water-soluble material according to claim 13, wherein the relative standard deviation (RSD) of the MALDI mass spectrum as measured at different spots of the specimen is 40% or less.

15. The method for quantitative analysis of a poorly water-soluble material according to claim 14, wherein the relative standard deviation (RSD) of the MALDI mass spectrum as measured at different spots of the specimen is 20% to 30%.

16. The method for quantitative analysis of a poorly water-soluble material according to claim 13, wherein the RSD of the MALDI mass spectrum as measured for a plurality of the specimens manufactured under the same conditions is 40% or less.

17. The method for quantitative analysis of a poorly water-soluble material according to claim 16, wherein the RSD of the MALDI mass spectrum as measured for a plurality of the specimens manufactured under the same conditions is 20% to 30%.

* * * * *